US007591096B2

(12) United States Patent
Krinke et al.

(10) Patent No.: US 7,591,096 B2
(45) Date of Patent: Sep. 22, 2009

(54) DISPLAY HOLDER

(76) Inventors: Thomas A. Krinke, 8632 County Road 4, Houston, MN (US) 55943; Alvern J. Krinke, 12185 Fletcher La., Rogers, MN (US) 55374

( * ) Notice: Subject to any disclaimer, the term of this patent is extended or adjusted under 35 U.S.C. 154(b) by 0 days.

(21) Appl. No.: 12/215,025

(22) Filed: Jun. 24, 2008

(65) Prior Publication Data

US 2009/0013573 A1 Jan. 15, 2009

Related U.S. Application Data

(60) Provisional application No. 60/958,896, filed on Jul. 10, 2007.

(51) Int. Cl.
*G09F 21/04* (2006.01)

(52) U.S. Cl. ..... 40/593; 40/746

(58) Field of Classification Search ..... 40/591–594, 40/597, 643, 644, 746, 748, 754, 755; 248/455, 248/460
See application file for complete search history.

(56) References Cited

U.S. PATENT DOCUMENTS

| | | | | |
|---|---|---|---|---|
| 1,436,544 | A | 11/1922 | Starr | |
| 2,027,676 | A * | 1/1936 | Chuchie | 40/643 |
| 2,833,072 | A | 5/1958 | Gregory | |
| 2,887,804 | A | 5/1959 | Wise | |
| 3,007,435 | A * | 11/1961 | Peterson | 116/28 R |
| 3,141,253 | A * | 7/1964 | Bartram | 40/593 |
| 3,168,070 | A | 2/1965 | Verney, Ill | |
| 3,213,556 | A * | 10/1965 | Cobbs | 40/649 |
| 3,313,053 | A * | 4/1967 | Vogeli, Sr. | 40/643 |
| 3,531,880 | A * | 10/1970 | Ramee | 40/643 |
| 4,058,917 | A | 11/1977 | Tallon | |
| 4,106,229 | A | 8/1978 | Schmid | |
| 4,132,022 | A | 1/1979 | Wood, Jr. | |
| 4,240,543 | A | 12/1980 | McKee | |
| 4,453,640 | A | 6/1984 | Cillario | |
| 4,456,126 | A | 6/1984 | Hicks, Jr. | |
| 4,462,175 | A | 7/1984 | Romberger | |
| 4,470,214 | A | 9/1984 | Kinloch | |
| D285,504 | S | 9/1986 | Messer | |
| 4,715,138 | A | 12/1987 | Cherico | |
| D296,569 | S | 7/1988 | Vela | |
| D296,707 | S | 7/1988 | Vea | |
| 4,897,945 | A | 2/1990 | Webb | |
| D318,820 | S | 8/1991 | Harvey | |
| 5,069,376 | A * | 12/1991 | Barel | 224/277 |
| 5,092,062 | A | 3/1992 | Palka | |
| 5,226,251 | A | 7/1993 | Webb | |
| 5,292,097 | A | 3/1994 | Russell | |
| 5,502,912 | A | 4/1996 | LeBoff et al. | |
| 5,577,337 | A | 11/1996 | Lin | |
| 5,671,331 | A | 9/1997 | Croley | |
| D388,468 | S | 12/1997 | Rife | |
| 5,947,521 | A | 9/1999 | Stucki | |
| 5,960,572 | A * | 10/1999 | DeVito | 40/593 |
| 6,032,394 | A | 3/2000 | Hand et al. | |
| D429,286 | S | 8/2000 | Luciani et al. | |
| 6,151,823 | A | 11/2000 | Gregory-Gillman | |
| 6,163,997 | A | 12/2000 | Deralas | |

(Continued)

*Primary Examiner*—Cassandra Davis
(74) *Attorney, Agent, or Firm*—Dardi & Associates, PLLC

(57) ABSTRACT

A device for displaying a disability parking certificate placard in a vehicle, with the device being movable from a storage position to a display position.

18 Claims, 4 Drawing Sheets

U.S. PATENT DOCUMENTS

| | | | | |
|---|---|---|---|---|
| 6,230,769 | B1 | 5/2001 | O'Brien | |
| 6,253,478 | B1 | 7/2001 | Kalavity | |
| D447,518 | S | 9/2001 | Lau | |
| 6,430,854 | B1 | 8/2002 | Szentgyorgyi et al. | |
| 6,446,374 | B1 * | 9/2002 | Ardiff | 40/593 |
| 6,560,847 | B2 | 5/2003 | Ohlsson | |
| 6,571,498 | B1 | 6/2003 | Cyrluk | |
| D477,368 | S | 7/2003 | Massey | |
| 6,651,369 | B1 | 11/2003 | Keating et al. | |
| 6,708,435 | B2 | 3/2004 | Massey | |
| 6,785,993 | B1 | 9/2004 | Lea | |
| 6,796,445 | B2 | 9/2004 | Cyrluk | |
| 6,851,556 | B1 | 2/2005 | Valdez et al. | |
| 6,886,282 | B2 | 5/2005 | Sumner, III et al. | |
| 6,962,505 | B1 | 11/2005 | Savicki, Jr. et al. | |
| 7,150,120 | B1 * | 12/2006 | Naymik | 40/643 |
| 2007/0203459 | A1 | 8/2007 | Mernoe | |
| 2007/0220793 | A1 * | 9/2007 | Mappes | 40/593 |
| 2008/0037629 | A1 | 2/2008 | Kim et al. | |

* cited by examiner

DISPLAY HOLDER

CROSS-REFERENCE TO RELATED APPLICATIONS

This application claims the benefit of U.S. Provisional Application Ser. No. 60/958,896 filed Jul. 10, 2007, which is hereby incorporated by reference herein.

TECHNICAL FIELD

The technical field relates to devices and methods for receiving and exhibiting a display, and more particularly, to a disability parking certificate enclosure for a vehicle.

BACKGROUND

Different types of displays are commonly exhibited in transportation devices, such as cars, trains, buses, and the like. These displays can include advertisements, parking permits, and the like. Parking permits can be government issued or privately issued permits. Government issued parking permits can include handicapped or disabled, residential or business area, commercial, delivery, messenger service, maintenance, angle loading, and media parking permits, and the like. Privately issued parking permits can be issued for privately owned parking lots for privately owned businesses or residential complexes.

SUMMARY

An embodiment of the invention is a unique holder for placards such as a disability parking certificate that can easily be converted from a placard display position and a placard storage position. Thus, when the vehicle is not in motion, the display position may be used to display a placard, for instance a handicapped parking permit, so that it is easily visible from outside the vehicle. When the vehicle is in motion, the display can be in the storage position, which is a position in the vehicle that is non-obstructive with respect to driving requirements. A variety of placards can be positioned in placard to permit viewing by the public or private or public enforcement authorities. The ability to quickly and conveniently change from display to storage position is an important safety feature and a significant convenience. In contrast, the driver conventionally is required to remove a placard when preparing to put the vehicle in motion and re-position it when the vehicle is not in motion or otherwise must be shown. A driver can easily forget to either remove or reattach the display as appropriate, resulting in a citation. Also, the placards tend to become fragile after prolonged exposure to light and high heat in a vehicle and can be damaged, or even lost by being blown out of the vehicle by a gust of wind or while the windows are down and the vehicle is moving.

The advantages of the display for the placard are, in fact, considerable. For instance, many households have more than one car, and persons within the household may switch from using one vehicle to another. The handicapped driver who has been issued a placard will need to bring the placard to the appropriate vehicle. Accordingly, one embodiment of the invention is to provide a detachable and easily accessed holder so either the display alone or the holder containing the display can be easily located and transferred from one vehicle to another.

Placards, such as parking permits, often come with a hook portion to suspend the placard from the rearview mirror of the vehicle. However, in some vehicles, the post portion of the rearview mirror has increased in size for purposes of design, accommodating the ONSTAR system, or the like, such that the placards do not fit the post, or are a poor fit that results in a poor display or damage to the placard. Additionally, displays break easily with several transfers between different vehicles, frequent repositioning, or adverse weather conditions. Accordingly, one embodiment of the invention is to provide a sturdy holder that can display a placard without being suspended from the rearview mirror and withstand frequent handlings and other adverse conditions.

The term placard as used herein is broad, and refers to a sign that provides visual information to a reader, either by way of text or symbol. Examples of placards are: plastic parking permits and paper permits. A parking placard is a term that refers to a placard with signage indicating permission to park in a location, e.g., a handicapped parking space. A parking placard may have a length of less than about 10 inches and a width of less than about 5 inches, although other sizes may be used. A parking placard may have a thickness of less than about one-eight of an inch, although other sizes may be used. A parking placard may be a plastic, although paper or other materials may be used. A type of parking placard is a disability parking certificate; artisans and members of the public are familiar with such certificates and will immediately recognize the same.

To achieve these and other advantages in whole or in parts, certain embodiments of the invention relate to a device for displaying a placard while other embodiments relate to a method of using the device to display the placard. The device may comprise a housing with a receptacle for receiving the placard, a mounting unit joined to the housing, and a joint between the housing and the mounting unit. The mounting unit may have a fixed or reversible fastener for mounting to the dashboard or the windshield, an may be sized and configured to fit at or near the intersection therebetween. In certain embodiments, the receptacle comprises a fastener for attaching to a windshield, and the mounting unit comprises a first fastener or attachment member. The joint may comprise a bendable member, a pivotable member, or bearing. The device can be manipulated between a first position (storage position) and a second position (display position). In either position, the mounting unit may be mounted to a vehicle's dashboard or windshield by a first fastener.

One embodiment of the invention relates to a device for displaying a placard from within a vehicle comprising a dashboard, a windshield, and an intersection between the dashboard and the windshield. The receptacle comprises a receptacle, a mounting unit, and a joint connecting the receptacle with the mounting unit. The mounting unit is mountable in a fixed position onto the dashboard, the windshield, or the intersection therebetween by a first fastener. The receptacle can be pivotable about the joint relative to the mounting unit. The receptacle can be fastened to the windshield by a second fastener.

Another embodiment of the invention relates to a method for displaying a placard from within a vehicle comprising a dashboard, a windshield, and an intersection between the dashboard and the windshield. The method comprises providing a device as described herein, mounting the mounting unit onto the dashboard, the windshield, or the intersection therebetween, resting the receptacle on the dashboard in a storage position, and pivoting the receptacle about the joint to a display position in which the second fastener is fastened to the windshield. The placard is visible through the windshield in both the storage position and the display position.

DETAILED DESCRIPTION OF PREFERRED EMBODIMENTS

Figure 1:
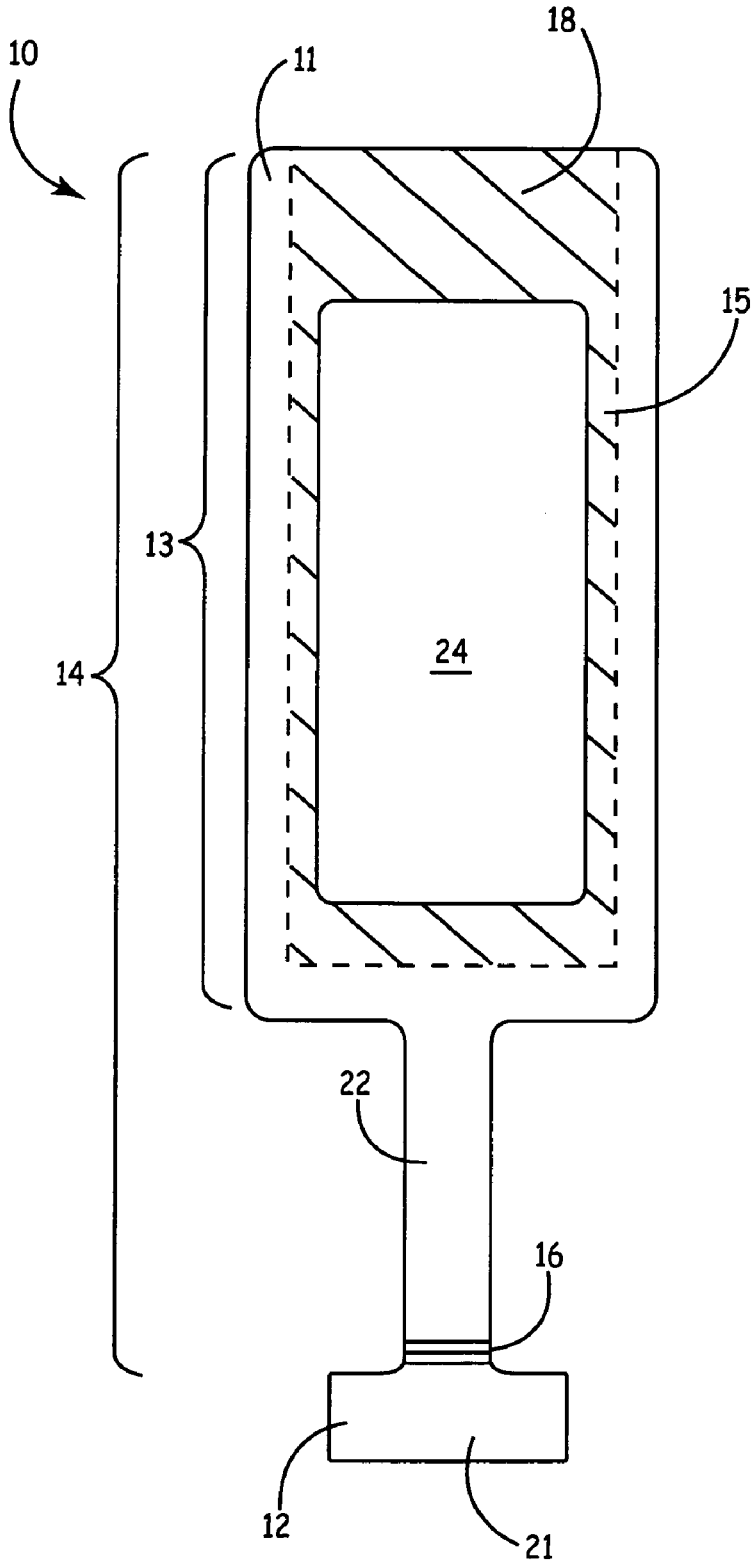
FIG. 1 is a plan view of a device for holding a display.

Referring to FIG. 1, a device 10 for holding and displaying a placard from within a vehicle is shown. The front side 11 of the device 10 is depicted. The device 10 comprises a receptacle 14, a mounting unit 12 extending from the receptacle 14, and a joint 16 between the receptacle 14 and the mounting unit 12. In FIG. 1, the receptacle 14 is positioned above the joint 16 and the mounting unit 12, and the joint 16 is positioned above the mounting unit 12, which is how one might mount the device in the vehicle. Alternatively, the device could be mounted in a reverse configuration with the mounting unit 12 above the joint 16, and the joint 16 above the receptacle 14. In other configurations, the device could be mounted such that the mounting unit 12 is folded above or underneath the receptacle 14.

The receptacle 14 comprises a housing 13 and an optional shaft 22 connecting the housing with the mounting unit 12 via joint 16. Housing 13 and the mounting unit 12 are located on opposite ends of device 10. In FIG. 1, housing 13 is positioned above shaft 22 and mounting unit 12, and the shaft 22 is positioned above the mounting unit 12. Shaft 22 can have the same or different width as the housing and can be an appropriate length to provide a desired degree of flexion at the joint, appropriate length to the device, and desired space for advertising or other insignia.

Figure 2:
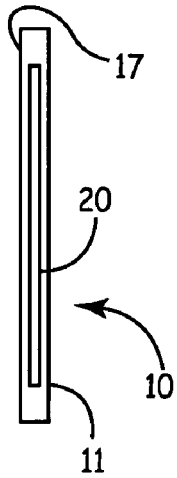
FIG. 2 is a top view of the device of FIG. 1.

Referring to FIG. 1, housing 13 comprises a pocket 18 that receives the placard. Optionally, pocket 18 may comprise suitable dimensions or gripping members for securely gripping the placard, e.g., a manual force fit for manually forcing the placard into the pocket to resist removal of the placard, tabs that lock the placard in place, or resilient plastic inserts that deform upon insertion of the placard and resiliently apply force to the placard to securely hold it in place. For instance, the gripping members can comprise at least one groove 15 or a slot surrounding all or a portion of the interior perimeter of the pocket, with the groove or slot being sized for a manual force fit. Referring to FIG. 2, an opening or slot 20 provides access into the pocket 18 so the placard can slide into or out of the pocket easily.

Optionally, either or both the front 11 or back 17 of the housing portion comprises an open area or window 24 to provide viewing of the placard. If only the front of the housing portion comprises the open area or window 24, back 17 can be used as advertising space or to otherwise provide information. Some embodiments of the invention are providing advertising or information for advertising in such a fashion.

The mounting unit 12 comprises a base portion 21 for reversible or fixed mounting. Either the front or back side of the base portion can be used to reversibly attach the mounting unit 12. The base portion can have a sufficient size for a fastener or attachment member to accomplish the reversible mounting. The base portion may have the same width as shaft portion 22 or be larger or smaller.

The mounting unit 12, the receptacle 14, and shaft portion 22 can have any suitable geometry, shape, and design. The mounting unit 12, the receptacle 14, and optional shaft portion can have the same or different geometry from each other. Referring to FIG. 1, in a two-dimensional perspective, they can have rectangular, circular, triangular shapes, or the like. In a three-dimensional perspective, the receptacle 14, optional shaft portion 22, and mounting unit 12 may all have shapes of a rectangular prism. Each of the receptacle 14, mounting unit 12, and optional shaft 22 can have the shape of a sphere or any n-sided prism with n=3, 4, 5, 6, 7, 8, 9, 10, 11, 12 . . . infinity.

The receptacle 14 and mounting unit 12 may comprise a second fastener for attaching to a vehicle's front windshield and a first fastener or attachment member for attaching to a vehicle's dashboard, front windshield, or at the intersection between the dashboard and front windshield, respectively. The joint 16 may comprise a pivotable or bendable member or a bearing that pivots the holding device 10 into a first display position when either the car is parked or the placard must be displayed or a second non-obstructive or storage position when the car is in motion.

In use, a placard is placed in the housing. The mounting unit is mounted permanently or reversibly to either the dashboard, front windshield, or at or near the juncture between the dashboard and front windshield by a first fastener. The device may rest on the dashboard in the storage position. A user moves the device to the display position by articulating the receptacle relative to the mounting unit and fastening the receptacle to the windshield by a second fastener.

The first or the second fastener may have all or a portion of the fastener permanently affixed to a vehicle. In the case of a fastener that requires to mating members for fastening, one mating member may be on the device and the other on the vehicle. For instance, one mating member may be a hook material and the other a loop material, as in VELCRO hook-and-loop fasteners. A variety of fasteners are available. Typically, these fasteners or attachment members should be able to withstand extreme conditions within the car (e.g. temperatures from about −20 degrees Fahrenheit to about 200 degrees Fahrenheit). These fasteners can be translucent or optically clear for optimal visibility through the windshield and aesthetic purposes. These attachment members include fasteners using VELCRO (e.g. 3M DUAL LOCK Fastener), magnets, adhesive (e.g. 3M Double Sided Tape), mating hook portions, or the like. These fasteners may be adhesive-backed for attaching to the dashboard, front windshield, or at their intersection. Alternatively, one or more of the mating surfaces can be permanently affixed to the device or to the vehicle. The receptacle and the mounting unit can use the same or different type of fasteners.

One advantage of using a shaft is that it may be sized to avoid interfering with air vents on or near the dashboard, with the shaft connecting the mounting unit to the housing, with the housing being commensurate in size to the placard and the shaft being relatively narrower. For instance, the shaft may be sized from about 3 inches to about 24 inches; artisans will immediately appreciate that all the ranges and values within the explicitly stated ranges are contemplated. The shaft may be, e.g., from about 0.1 inches to about five inches in maximum width; artisans will immediately appreciate that all the ranges and values within the explicitly stated ranges are contemplated, e.g., from about 0.5 to about 2 inches. In some embodiments, a telescoping shaft is used to provide a range of shaft lengths selectable by a user.

Figure 3:
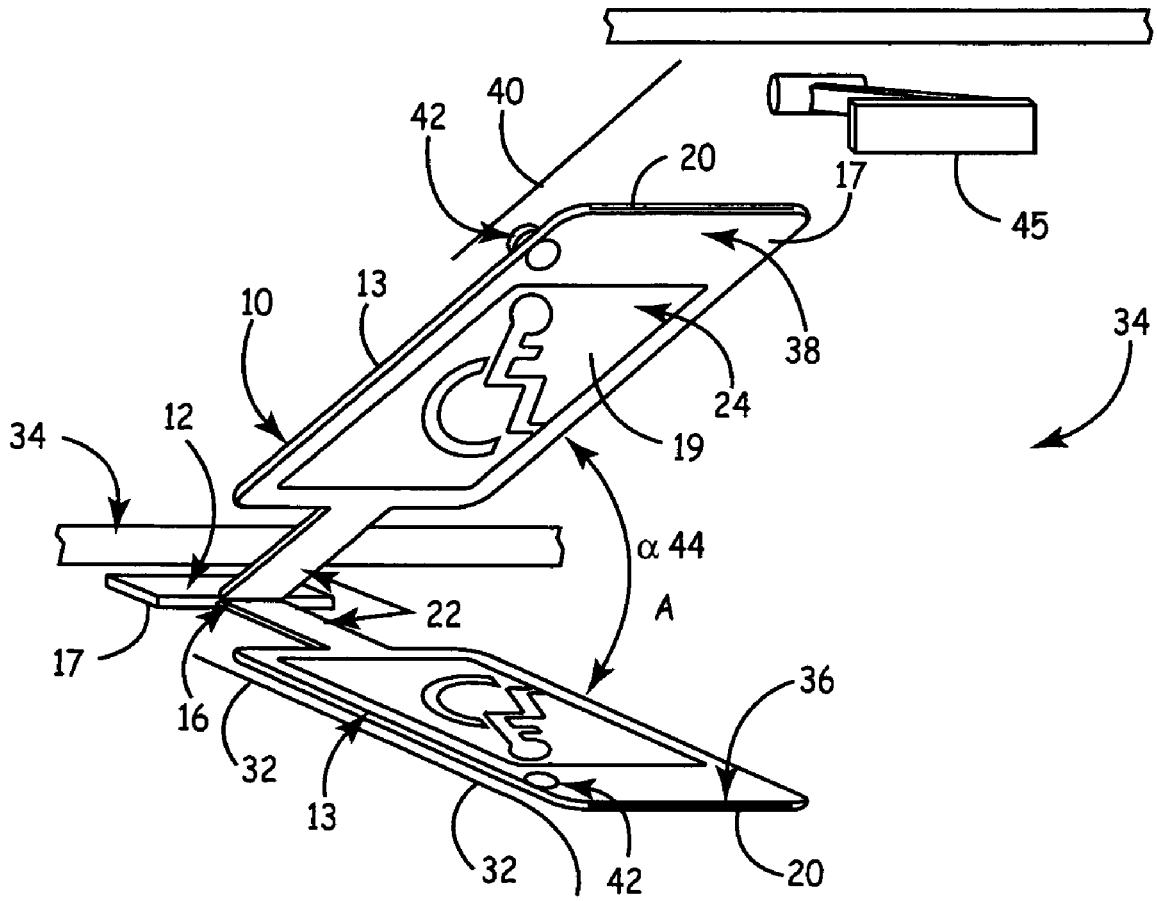
FIG. 3 is a perspective view of a method of mounting or using the device of FIGS. 1 and 2.

FIG. 3 depicts an embodiment of display device 10 in use. Device 10 rests on the dashboard 32 of vehicle 34 in storage position 36. Mounting unit 12 is affixed permanently or reversibly to dashboard 32 by face 17. A user moves device 10 as indicated by arrow A from storage position 36 to display position 38 and reversibly affixes it to windshield 40 by fastener 42. Angle alpha indicated at 44 is about 45 degrees; other angles may be created by changing the mounting location or according to the particular geometry of a specific windshield-dashboard combination, e.g., from about 10 to about 120 degrees; artisans will immediately appreciate that all the ranges and values within the explicitly stated ranges are contemplated. In movement, joint 16 is rotated through angle alpha. Housing 13 holds placard 19, which can be viewed through window 24 and through the windshield by a person standing outside the vehicle. Rearview mirror 45 is shown in vehicle 34. Shaft 22 provides for the holder to extend across air vents (not shown) in the vehicle to avoid unwanted movement or redirection of vented air flow.

Figure 4B:
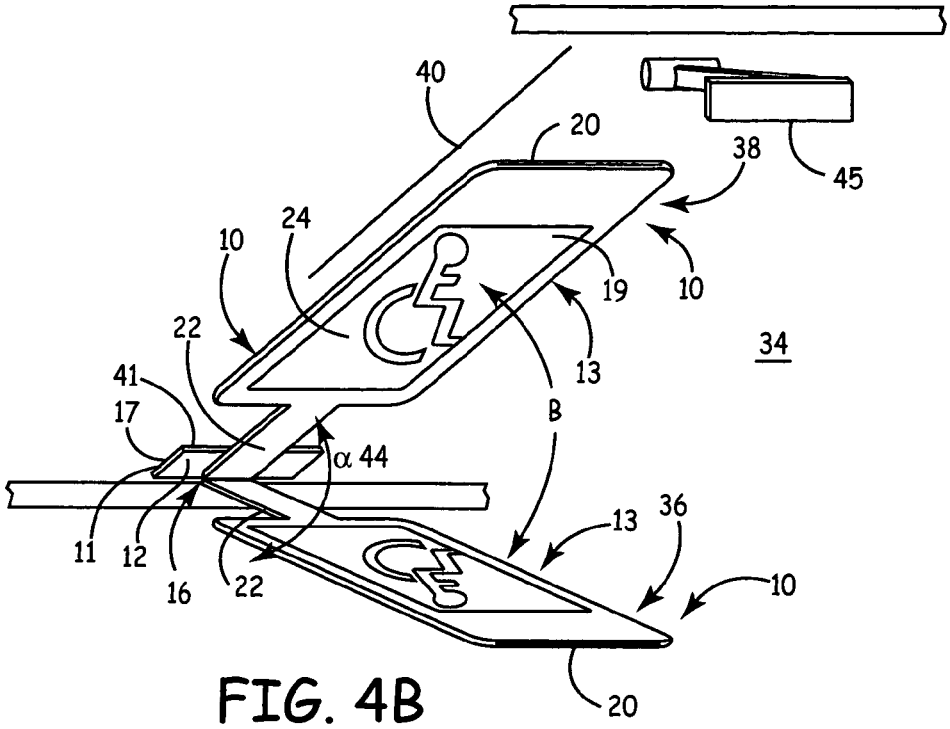
FIG. 4B depicts an alternative method of mounting or using the device of FIGS. 1-3.
Figure 4A:
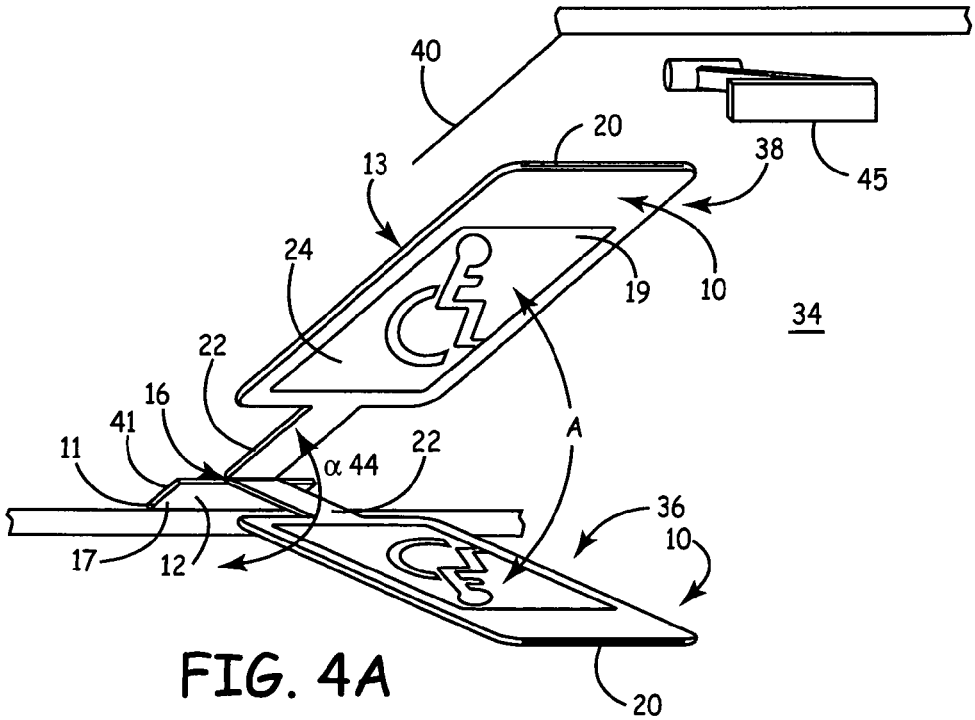
FIG. 4A depicts an alternative method of mounting or using the device of FIGS. 1-3.

FIGS. 4A and 4B show alternative mounting arrangements. Device 10 is mounted by mounting unit 12 to windshield 40 by fastener 41. Movement between storage position 36 and display position 38 is accomplished by rotation through angle alpha as at 44, with movement being as indicated by arrows A or B. FIGS. 4A and 4B are distinguished by the angle alpha, indicated at 44, that the joint rotates through when changing positions, as caused by the face of mounting unit 12 that is used for mounting, i.e., side 11 (FIG. 4B) or side 17 (FIG. 4A) of device 10. In some embodiments, angle alpha is limited to less than about 90 degrees or less than about 75 degrees, while other embodiments provide for more or less rotation. Housing 13 holds placard 19, which can be viewed through window 24 and through windshield 40 by a person standing outside the vehicle. Rearview mirror 45 is shown in vehicle 34. Shaft 22 provides for the holder to extend across air vents (not shown) in the vehicle to avoid unwanted movement or redirection of vented air flow.

Figure 5B:
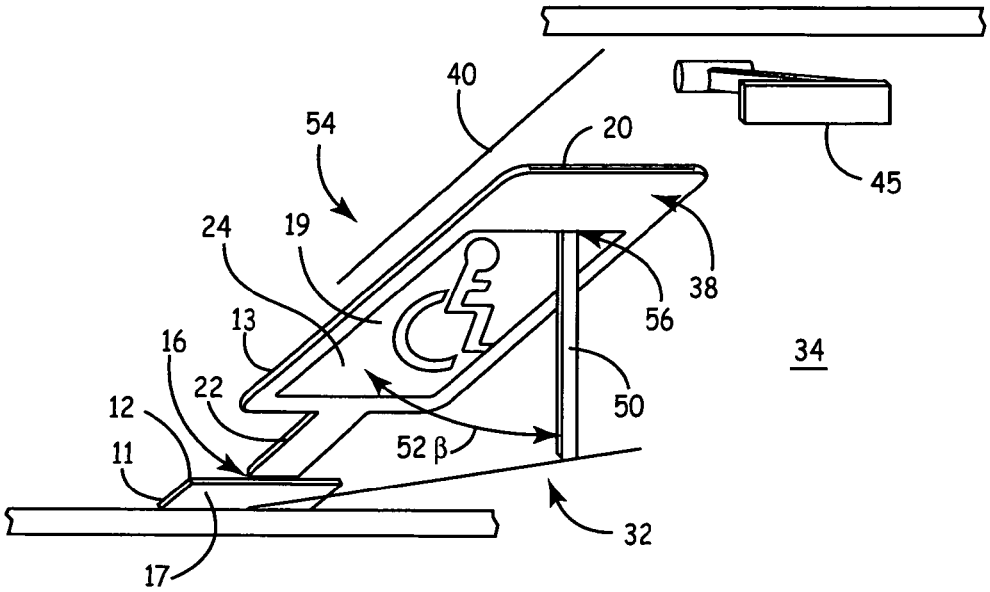
FIG. 5B depicts the device of FIG. 5A with the support leg in a storage position.
Figure 5A:
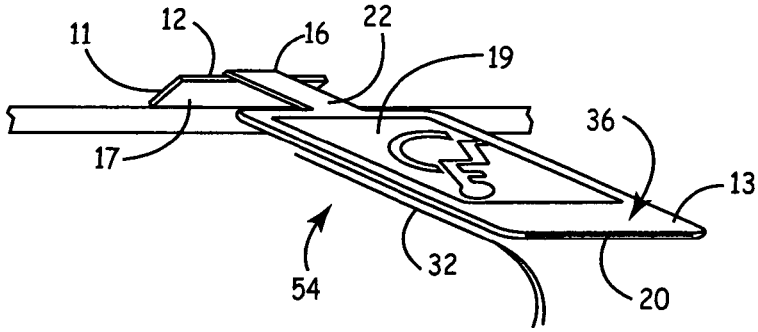
FIG. 5A depicts an alternative device with a support leg in a display position.

FIG. 5 depicts alternative device 54 mounted by mounting unit 12 to windshield 40 by a fastener (not shown). Movement between storage position 36 and display position 38 is accomplished by rotation around hinge 16 Housing 13 holds placard 19, which can be viewed through window 24 and through windshield 40 by a person standing outside the vehicle. Rearview mirror 45 is shown in vehicle 34. Shaft 22 provides for the holder to extend across air vents (not shown) in the vehicle to avoid unwanted movement or redirection of vented air flow. Support leg 50 is provided that is pivotable about joint 56 through angle beta as at 52. The leg is extendable downwardly to contact dash 32 in the display position and folded up against housing 13 in the storage position. The leg may be attached to the housing by a joint that allows the leg to be pivoted from a parallel position substantially parallel to the housing (storage position) to a position at least about 30 degrees away from the parallel position (display position); e.g., from about 30 to about 180 degrees, or alternatively from about 15 to about 90 degrees; artisans will immediately appreciate that all the ranges and values within the explicitly stated ranges are contemplated, e.g., about 45 degrees or from about 30 to about 60 degrees. In use, the leg attached to the housing by a joint may be pivoted when moving the device from the storage position to the display position, with the leg resting on a dashboard of the vehicle to support the housing in the display position.

As is evident from the forgoing description, once the mounting unit is mounted in a fixed position, the receptacle is pivotable relative to the mounting unit to reversibly fasten to the windshield. The mounting unit can be mounted anywhere on the dashboard, the windshield, or the intersection therebetween. For example, the mounting unit can be mounted at or near the intersection of the dashboard and the windshield from about 0 to about 6 inches from the intersection on the dashboard or windshield; artisans will immediately appreciate that all the ranges and values within the explicitly stated ranges are contemplated, e.g., from about 1 to about 3 inches.

As is evident from the Figures, the mounting unit can be mounted on its "front" or "back" side. For instance, if the mounting unit is mounted using its front on the dashboard, the mounting unit can rest on the dashboard behind the receptacle or its shaft portion in the storage or non-obstructive position. Or, if the mounting unit is mounted using its front on the windshield or the intersection between the windshield and the dash, the receptacle can suspend from the mounting unit and rest on the dashboard. In the display position, the device may thus be configures to likely attach flush to, or substantially parallel to, the windshield.

The dashboard or dash is a control panel located under the windshield of a transportation device. The intersection between the dash and the windshield can comprise of a small space from about 0 to about 3 inches, and some embodiments place the mounting unit in this zone.

A variety of joints are available to move the mounting unit between the positions, and may include hinges (e.g. living hinge, door hinge, butler tray hinge, carpenter joint, floating hinge) or the like. There are many types of door hinges, and they include but are not limited to pivot hinges, butt/mortise hinges, continuous hinges, concealed hinges, butterfly or parliament hinges, strap hinges, H hinges, HL hinges, counterflap hinges, flush hinges, coach hinges, rising butt hinges, double action spring hinges, tee hinges, friction hinges, security hinges, cranked or stormproof hinges, lift-off hinges, self-closing hinges, and butt hinges. The joint may alternatively be a bendable member, e.g., a flexible plastic.

The holding device 10, 54 can have suitable dimensions to accommodate different placards. To hold a parking placard, the housing portion can be, in some embodiments, about 4½ inches in width and about 10 inches in length, and the pocket can be about 3¾ inches in width and about 9⅜ inches. The pocket can have about a 0 inch clearance from the upper edge of the housing portion, about a 7/16 inch clearance from the side edges of the housing portion, and about a ⅝ inch clearance from the bottom edge of the housing portion. An optional shaft portion can be about 1 inch in width and 4 inches in length. The base portion can be about 2¼ inches in width and about 1 inch in length. The optional open area or window 24 can be about 3¼ inches in width and about 6⅞ inches in length. The optional open area or window 24 can have about a 1¾ inch in clearance from the upper edge of the housing portion, about a 11/16 inches in clearance from the side edges of the housing portion, and about a 1⅜ inches in clearance from the bottom edges of the housing portion. The open area or window can be sufficiently large to provide viewing of the placard but afford sufficient clearance from the side edges on the front of the receptacle (including the housing portion and shaft portion) for advertisements or sponsors. Including the shaft portion, the total length of the holding device is about 15 inches. The dimensions above can vary by 0 to ¼ inches or 0 to 1/16 inches.

The holding device can be made using different methods including molding (e.g. injection molding) or the like. The holding device can be made in one-piece or by putting together several pieces. The holding device can comprise two mating pieces. The first and second pieces can each comprise a receptacle and a mounting unit, and the receptacles of each of the pieces can mate with each other while the mounting units of each of the pieces can mate with each other. Alternatively, one of the first and second pieces can comprise both a first and mounting unit while the other piece can comprise only a mounting unit with only the mounting units of the pieces mating. The mating structure between the pieces can be a snap type (e.g. bayonet snap) with the mounting unit of one of the pieces comprising a protrusion while the mounting unit of the other piece comprises a depression with the protrusion and depression mating to form the assembled device. The pieces can also be fused together by sonic welding. Other mating structures or methods will be readily apparent to one of ordinary skill in the art. The optional open area(s) or window(s) can be produced during the molding process or cut into the pieces after the molding has been complete.

The holding device can be constructed from a variety of flexible, durable materials, including plastics, metals, woods, or the like. Alternatively or additionally to the open area or window, the plastic can be transparent to allow viewing of the placard that is contained. The plastic can also be sufficiently pliable or flexible to accommodate a living hinge. Suitable plastics include polypropylene, polymethylmethacrylate, polyethylene, polycarbonate, polystyrene, composites thereof, or the like. Different parts of the holding device can be constructed of different materials. For example, the receptacle and the mounting unit can be made of a more rigid material (e.g. polycarbonate) than the living hinge (e.g. polyethylene).

The foregoing embodiments are merely exemplary and are not to be construed as limiting the invention. Certain features have been described in particular embodiments; in general, such features may be mixed-and-matched as guided by the requirement of making a functional device.

What is claimed is:

1. A device for displaying a disability parking certificate placard from within a vehicle comprising a dashboard and a windshield comprising:

a receptacle to receive a disability parking certificate placard for display connected by a first joint to a mounting unit that is mountable in a fixed position on the dashboard, the windshield, or an intersection therebetween by a first fastener, with the receptacle further comprising a second fastener for fastening to the windshield, and with the receptacle being pivotable about the joint relative to the mounting unit, and further comprising a leg attached to the receptacle by a second joint that allows the leg to be pivoted from a parallel position substantially parallel to the housing to a position at least about 30 degrees away from the parallel position;

wherein the leg and the second fastener are on opposite sides of the receptacle.

2. The device of claim 1, wherein the receptacle comprises a housing portion for receiving the placard through a slot positioned on an edge of the housing portion.

3. The device of claim 2, wherein the receptacle comprises a shaft portion positioned between the housing portion and the mounting unit.

4. The device of claim 3, wherein the housing portion comprises a window for viewing the placard received in the receptacle.

5. The device of claim 4, wherein the first joint comprises a living hinge.

6. The device of claim 5, wherein the first fastener and the second fastener each comprise two mating elements:

wherein one mating element of the first fastener is attached to the dashboard, the windshield, or the intersection therebetween and the other mating element of the first fastener is attached to the mounting unit; and wherein one mating element of the second fastener is attached to the windshield and the other mating element of the second fastener is attached to the receptacle.

7. The device of claim 5, wherein the first fastener and the second fastener are selected from the group consisting of hook and loop fastener, magnets, adhesive, and hooks.

8. A method for displaying a placard from within a vehicle comprising a dashboard and a windshield comprising:

providing a receptacle to receive a disability parking certificate placard for display connected by a first joint to a mounting unit that is mountable in a fixed position onto the dashboard or the windshield by a first fastener, with the receptacle further comprising a second fastener for fastening to the windshield, and with the receptacle being pivotable about the joint relative to the mounting unit;

mounting the mounting unit onto the dashboard or the windshield;

resting the receptacle on the dashboard in a storage position;

pivoting the receptacle about the joint at least thirty degrees from the storage position to a display position wherein the second fastener is fastened to the windshield, with the placard being visible through the windshield in the storage position and the display position, wherein the device further comprises a leg attached to the receptacle with a second joint, and pivoting the leg about the second joint at least about 30 degrees after moving the device from the storage position to the display position, with the leg resting on a dashboard of the vehicle in the display position to support the housing in the display position.

9. The method of claim 8, further comprising placing the placard in the receptacle using a force fit.

10. The method of claim 8, wherein the receptacle comprises a housing portion having a slot positioned on an edge of the housing portion for receiving the placard into the housing.

11. The method of claim 10, wherein the receptacle comprises a shaft portion positioned between the housing portion and the mounting unit.

12. The method of claim 11, wherein the housing portion comprises a window for viewing the placard received in the receptacle.

13. The method of claim 12, wherein the first fastener and the second fastener each comprise two mating elements;

wherein one mating element of the first fastener is attached to the dashboard or the windshield and the other mating element of the first fastener is attached to the mounting unit; and wherein one mating element of the second fastener is attached to the windshield and the other mating element of the second is attached to the receptacle.

14. The method of claim 13, further comprising attaching the mating elements of the first fastener and detaching the mating elements of the second fastener to place the receptacle in the storage position.

15. The method of claim 14, further comprising attaching the mating elements of the first fastener and the second fastener to place the receptacle in the display position.

16. The method of claim 15, further comprising removing the receptacle, the mounting unit, and the first joint connecting the receptacle and the mounting unit from the vehicle by detaching the mating elements of the first fastener and the second fastener.

17. The device of claim 15, wherein the first fastener and the second fastener are selected from the group consisting of hook and loop fastener, magnets, adhesive, and hooks.

18. The method of claim 8, wherein the first joint comprises a living hinge.

* * * * *